United States Patent [19]

Sanders

[11] B 3,985,557

[45] Oct. 12, 1976

[54] METHOD OF PRODUCING A HIGH STRENGTH COMPOSITE OF ZIRCON

[75] Inventor: Robert N. Sanders, Baton Rouge, La.

[73] Assignee: Ethyl Corporation, Richmond, Va.

[22] Filed: Nov. 21, 1974

[21] Appl. No.: 525,961

[44] Published under the second Trial Voluntary Protest Program on January 13, 1976 as document No. B 525,961.

Related U.S. Application Data

[60] Continuation of Ser. No. 349,228, April 9, 1973, abandoned, which is a division of Ser. No. 210,127, Dec. 20, 1971, abandoned.

[52] U.S. Cl. ..... 75/135; 75/138; 75/147

[51] Int. Cl.[2] ..... C22C 1/10; C22C 21/00

[58] Field of Search ..... 75/135, 138, 147; 29/182.5

[56] References Cited

UNITED STATES PATENTS

| | | | |
|---|---|---|---|
| 2,793,949 | 5/1957 | Imich | 75/135 |
| 2,949,358 | 8/1960 | Alexander | 75/176 |
| 3,468,658 | 9/1969 | Herald | 75/122 |

*Primary Examiner*—L. Dewayne Rutledge
*Assistant Examiner*—Arthur J. Steiner
*Attorney, Agent, or Firm*—Donald L. Johnson; John F. Sieberth; Paul H. Leonard

[57] ABSTRACT

An aluminum composite comprising aluminum as the principal metal, an alkaline earth metal or an alkali metal as a reducing agent, and a substantial amount of a non-metal filler such as zircon, alumina, zirconia or aluminum silicates, and a method of manufacturing said aluminum composite.

6 Claims, No Drawings

METHOD OF PRODUCING A HIGH STRENGTH COMPOSITE OF ZIRCON

This is a continuation of application Ser. No. 349,228, filed on Apr. 9, 1973, which in turn is a division of application Ser. No. 210,127, filed on Dec. 20, 1971, both of which are now abandoned.

BACKGROUND OF THE INVENTION

The present invention is in the general field of metallurgy and relates particularly to non-ferrous metallurgy. The invention is especially related to aluminum or aluminum alloys.

It has been previously discovered, U.S. Pat. No. 2,793,949, that inorganic substances may be incorporated in metals to produce a composite material product. It is taught therein that mixtures of molten metals, including aluminum, and a large variety of inert fillers, including alumina, may be smelted together if the non-metallic material to be incorporated into the metal is wetted by the molten metal used. The wetting agents chosen are those among substances which are capable of lowering the surface tension between the metals and the materials to be incorporated therein. Such prior art also teaches that to modify the structural properties of a metal only slight amounts, less than 1 percent, say 0.1 percent, of powders or crystal materials should be added to the metal. On the other hand, when the object is to obtain, for example, abrasive compositions, the ratio of hard materials to be mixed with the molten metal should preferably exceed 50 percent by volume of the composite product and may be as high as 95 percent. Although a wide variety of metals and fillers are disclosed, no commercial success has apparently been achieved with the use of any compositions prepared by such process. Also, a number of the compositions disclosed in the reference are highly dangerous, being in fact explosive compositions.

It is therefore a primary object of the present invention to provide a new and improved aluminum composite which has sufficient strength to perform the required or desired use thereof and which is considerably less expensive than presently available aluminum alloys, especially aluminum casting alloys.

The instant invention is particularly adapted for use in the manufacture of articles wherein maximum strength for aluminum is not required and wherein slight changes in density would be of no consequence. Some examples of such articles are lawnmower housings, office machine cases and certain small engine parts.

It is also a primary object of the present invention to provide an aluminum composite which exhibits improved properties such as tensile strength, hardness and toughness.

An important object of the present invention is to provide an aluminum composite which may be remelted and cast without any significant loss of its physical or structural properties.

Another object of the present invention is to provide a method for manufacturing an aluminum composite of material in which the physical properties may be varied over a wide range as desired, by appropriate changes in the composition.

Still another object of the present invention is to provide a new and useful aluminum composite which is substantially uniform in construction.

Other objects and advantages of the invention will become more readily apparent from a reading of the specification hereinafter.

SUMMARY OF THE INVENTION

The invention relates to a new article of manufacture, consisting essentially of an aluminum composite containing aluminum as its principal element, an alkaline earth metal or an alkali metal, especially magnesium, in sufficient quantity to be an effective reducing agent, and a substantial amount of an inert non-metallic filler such as zircon, alumina, zirconia and aluminum silicates, and a method of preparing said article wherein the metallic or metal alloying elements are heated to sufficient temperature to achieve good fluidity and the filler material is stirred therewith with sufficient stirring to distribute the filler throughout the molten metal.

DESCRIPTION OF THE PREFERRED EMBODIMENT

The composite article of the invention comprises three principal ingredients, aluminum, a metal reducing agent for reducing the surfaces of a non-metallic filler to a metal-like coating, and a non-metallic filler which is not subject to being reduced by aluminum metal and which can be effectively reduced by the metal reducing agent. Aluminum or aluminum alloys substantially of aluminum are the preferred principal metal of the alloy composition. Magnesium is the preferred metal reducing agent with other alkaline earth or alkali metals, such as calcium, beryllium, sodium, potassium rubidium and cesium, being suitable. The alkali metals have a relatively low solubility in aluminum, e.g., sodium is soluble only to about 0.25 weight percent at 775°C. These alkali metals therefore, although being suitable, have somewhat limited use. Preferred non-metallic fillers are zircon and alumina. Zirconia and aluminum silicates are also suitable.

When the composite material or article of this invention comprises magnesium and zircon, the magnesium is preferably in an amount by weight of about 2–10 percent of the metallic phase, with about 4.5 weight percent magnesium producing optimum results. When zircon is used as the non-metallic filler, the zircon may comprise from about 5–80 percent by weight of components, with about 10–40 percent being more preferred and about 30–35 percent most preferred. The amount of magnesium or metal reducing agent required will vary somewhat with the amount of zircon or non-metallic filler in the article.

The particle size of the filler may vary from about 60 mesh to about 400 mesh, U.S. Sieve Series, with a particle size of 100/140 mesh producing an excellent product. A filler or filler material of a distribution of particle sizes is preferable.

In the most preferred way of preparing or making the composite article of the present invention, aluminum and all metallic alloying elements except magnesium and zinc (if the alloy is to contain zinc) are heated to a temperature sufficient to achieve good fluidity, usually about 850°C in a suitable furnace or crucible. The temperature necessary will vary with the particular alloying elements selected and the amount of inert filler to be added. The temperature will range between the melting point and the boiling point of the alloying elements. In general, it is desirable to use as low a temperature as will provide the desired degree of fluidity of the metallic phase.

After the desired temperature has been reached, the magnesium reducing metal and zinc, if zinc is included, are added to the molten metal or alloy. Stirring is commenced and the filler is added. Although the filler may be added cold, it is preferably preheated to a temperature of about that of the melt. Stirring is continued until the filler is dispersed throughout the molten metal, usually about 5 minutes. The time of stirring will vary somewhat with the amount of filler added, and in general as short a stirring time as necessary to achieve adequate particle distribution is preferred. Optimally, the mixture is stirred until the filler is substantially equally distributed throughout the melt.

After mixing or stirring the molten mixture is cast in the form of ingots or other desired shapes.

When using a pre-prepared or standard aluminum-magnesium alloy as the metallic phase, the alloy is heated to temperature and the non-metallic filler is added thereafter. The molten mixture is stirred sufficiently to draw the filler into the molten phase.

In another way of carrying out the present invention, all of the ingredients of the composite article, except the metal reducing agent, preferably magnesium, are mixed together and heated to temperature. Magnesium is then added and the mixture stirred. Dross is skimmed from the molten mixture and the melt is then cast. This procedure reduces dross.

The aluminum composite or article of the instant invention may also be prepared by mixing all of the components of the article, namely aluminum, metal reducing agent, and non-metallic filler, together, then heating to desired temperature and stirring. The dross is skimmed from the melt and the molten mixture is poured into a mold and cast into a suitable shape. This procedure is preferably followed under an argon purge. Such a purge eliminates some dross from forming.

In order to facilitate understanding of the invention, the following examples are illustrative thereof; however, it is understood that these examples do not limit the scope of the invention in any fashion.

GENERAL PROCEDURE

The apparatus consisted of an electric heating element inside a firebrick housing, a foundry crucible, a motor-driven stirrer and a carbon rod baffle. Aluminum metal and non-metallic filler, such as zircon or alumina were mixed in the crucible, heated to temperature and stirred. The charge was then poured into a crucible. After cooling, the casting was cut in half vertically and three samples drilled out, one near the top, middle and bottom.

Particle size distribution of the alumina and zircon fillers were as follows, unless otherwise specified:

| Particle Size | Weight Percent | |
|---|---|---|
| | Alumina | Zircon |
| 40/70 | 0.0 | 2.2 |
| 70/100 | 4.5 | 19.1 |
| 100/140 | 52.5 | 53.4 |
| 140/200 | 19.7 | 7.2 |
| 200/325 | 18.2 | 7.3 |
| 325/400 | 2.9 | 7.3 |
| 400/— | 2.2 | 3.5 |

EXAMPLE 1

A mixture by weight of 140 parts of aluminum pellets and 50 parts of minus 400 mesh alumina were heated to 800°C and then 10 parts of magnesium were added. After 5 minutes of stirring the mixture was cast and cooled. All but two parts of the alumina were incorporated in the cast product. The plug was machined and an oxygen analysis was made on the filings as well as on the three usual drill samples. They indicated 26.8 percent alumina in the bottom, 25.5 percent in the middle and 13.2 percent on the top. The filings contained 21.9 percent alumina.

The foregoing was repeated using 130 parts of Al, 60 parts of $Al_2O_3$ and 10 parts of Mg. Twenty-six parts of alumina were not incorporated in the composite. The above was repeated using a new stirrer and in this case the mixture was so viscous that it could not be poured. Oxygen analysis on the product indicated 23.8 percent $Al_2O_3$ equivalent.

EXAMPLE 2

By weight, 700 parts of aluminum and 250 parts of alumina were heated until the system was liquid then the stirrer was submerged and the entire system heated to 850°C. At that point 50 parts of magnesium were added and stirred for 1 minute with a variable speed electric motor. The composite product was cast and cooled. Analysis indicated 21.0 percent $Al_2O_3$ in the material.

The foregoing was repeated using 300 parts of $Al_2O_3$, 50 parts of Mg, and 650 parts of Al. The speed of the stirrer was increased slightly, and stirring was continued for five minutes. A boat mold was used but was filled through a ⅜ inch hole cut in the bottom of a graphite crucible. The crucible had been preheated to 525°C. The composite product was cast and cooled. All of the alumina was incorporated in the composite. Analysis indicated 28.8 percent alumina filler in the composite. A crude tensile strength specimen was machined from the casting and the tensile strength determined as about 16,000 lbs/in.$^2$.

A quantity of the machine turnings from the casting were remelted at 871°C and maintained for 40 minutes with no alumina separating out on recasting.

EXAMPLE 3

By weight, 250 parts of $Al_2O_3$ and 690 parts of Al were heated to 850°C and the stirrer added as before. After the addition of 60 parts of Mg the mixture was stirred. The composite product was cast and cooled. No alumina separated out.

The foregoing was repeated with a new stirrer and using 250 parts of $Al_2O_3$, 700 parts of Al, and 50 parts of Mg and again all of the alumina was incorporated in the composite casting. Repeating the same procedure using 250 parts of $Al_2O_3$, 710 parts of Al, and 40 parts of Mg gave substantially the same good results.

EXAMPLE 4

The same procedure was followed as in Example 2 except zircon was used in place of alumina. All of the zircon was incorporated and analysis indicated 24.8 percent filler.

EXAMPLE 5

The stirrer was coated with Fiberfrax Coating Cement type QF-180 (Carborundum Co.). A mixture by weight, of 250 parts of $Al_2O_3$ (alumina) and 710 parts of Al were heated to 850°C, then 40 parts of Mg were added. After 25 minutes the stirrer was submerged and after another 5 minutes it was stirred for 5 minutes. The composite product was cast and cooled. Essentially all of the alumina was incorporated. A second sample was prepared following the same procedure except that zircon was used in place of alumina. A sample of 710 parts of Al and 40 parts of Mg were melted, mixed and cast. A Rockwell E hardness was determined on each of the castings. The results are set forth in Table I, hereinafter.

EXAMPLE 6

Example 5 was repeated using by weight, 250 parts of zircon, 671 parts of Al, and 79 parts of Mg. All of the zircon was taken in. Rockwell E hardness tests were made on the sample before and after heat treatment at 1000°F for one hour with water quenching. The results are illustrated in Table I, hereinafter.

Table I

| Sample | % Al | % Mg | % Filler | Filler Material | Hardness Rockwell E |
|---|---|---|---|---|---|
| Ex. 5-1 | 71.0 | 4.0 | 25.0 | Alumina | 30 |
| Ex. 5-2 | 71.0 | 4.0 | 25.0 | Zircon | 43 ± 9[a] |
| Ex. 5-3 | 94.7 | 5.3 | 0.0 | — | 10 |
| Ex.. 6-1 | 67.1 | 7.9 | 25.0 | Zircon | 67.6 ± 8.2[a] |
| Ex. 6-2[b] | 67.1 | 7.9 | 25.0 | Zircon | 63.1 ± 6.7[a] |

[a]Standard deviation.
[b]After heat treatment.

EXAMPLE 7

1150 parts of aluminum and 50 grams of calcium were mixed and heated in a furnace to 800°C. While stirring, 400 parts of zircon were added and stirring was continued for 5 minutes. The mixture was cooled to 700°C and cast. A hardness test was made on the cast product which produced a Rockwell E hardness of 35.6 ± 6.5.

Similar tests using bismuth, a more effective metal at lowering surface tension, showed that bismuth was not capable of reducing the filler surface and was completely ineffective in producing a satisfactory composite article. Other tests using quartz as a filler indicated that the filler must be sufficiently stable so that it will not be reduced by the aluminum, but must be reduced by the metal reducing agent, namely magnesium.

The foregoing tests and other tests, showed that to obtain successful results at a 25–30 percent by weight filler level, there must be effective stirring. The stirrer must also be in good condition and run at effective speeds. When contact times are on the order of 5 minutes, a minimum of about 4 percent by weight of magnesium is required to produce a satisfactory product. At a higher percentage of magnesium loadings, the contact time may be shorter. Stirring or contact time and amount of filler go together. The degree of reduction of the filler is determined by the kinetics of the reduction which in turn is dependent on the concentration-time ratio.

Once the powdered filler was incorporated it showed little tendency to separate by any mechanism other than Stokes law settling of the particles. Settling is quite slow because of the smallness of the grains, the high viscosity of the metallic phase and the extreme similarity of the particle and melt density, especially with alumina as the filler. Uniquely, no separation of particles was observed when the filled products were remelted and recast.

An increase in temperature of the mixture of about 20°C was observed when the filler was added. This increase is due in part to stirring and chemical reaction.

Tin, which is an effective metal for reducing surface tension of aluminum, would not provide the reducing action necessary for a successful product.

Hardness is a physical property that will have an effect on the useability of the filled product as a replacement for other aluminum casting alloys. The normal hardness range for such casting alloys is from a Brinell number of about 40 to a Brinell number of about 110.

It may be seen that while there is a significant increase in hardness between the basic aluminum-magnesium alloy and the same alloy with filler, i.e., a factor of about 2 with 25 percent alumina and about 3 with 25 percent zircon, the best values obtained are still in the lower portion of the desired range.

EXAMPLE 8

Following the procedures as previously described, a variety of composites were prepared. Hardness and tensile strength of these composites were compared as a function of the level of zircon loading at various percentages from 0 to 60 for aluminum alloys as follows:

| Alloy | Percent by Weight of Elements in Metallic Phase | | | |
|---|---|---|---|---|
| | Al | Mg | Zn | Cu |
| A | 81.4 | 8.6 | 10.0 | — |
| B | 77.4 | 8.6 | 10.0 | 4.0 |
| F214 | 96.0* | 4.0* | —* | —* |

*A standard commercial sand casting alloy with percent by weight Chemical Composition Limits as follows: Mg — 3.6 to 4.5; Si — 0.3 to 0.70; Fe — 0.30 max.; Cu — 0.10 max.; Mn — 0.10 max.; Zn — 0.10 max.; Ti — 0.20 max.; misc. elements — 0.05 each max.; total — 0.15 max.; balance Al.

A single step heat treatment of 18 hours at 810°F or 650°F followed by an air quench was used. The high value only was used for the tensile strength value and the yield value obtained for each specimen. For alloy B, heat treatment was also run at 250°F. The results are recorded in Table II.

Table II

| Hardness and Strength | | | | | | |
|---|---|---|---|---|---|---|
| | | | Rockwell E Hardness | | | |
| Weight Percent Alloy | Weight Percent Zircon | As Cast | 810°F Heat Treatment | 250°F Heat Treatment | Yield Strength kpsi | Ultimate Tensile Strength kpsi |
| | | | Alloy A | | | |
| 100 | 0 | 77.0 | 75.9 | — | 3.7 | 11.9 |
| 90 | 10 | 75.5 | 69.8 | — | 4.4 | 11.0 |
| 85 | 15 | 78.7 | 74.2 | — | Not Available | 5.4 |
| 80 | 20 | 73.9 | 74.3 | — | 4.4 | 13.4 |
| 75 | 25 | 74.3 | 72.8 | — | 3.3 | 13.3 |

Table II-continued

| Hardness and Strength | | | | | | |
|---|---|---|---|---|---|---|
| | | | Rockwell E Hardness | | | |
| Weight Percent Alloy | Weight Percent Zircon | As Cast | 810°F Heat Treatment | 250°F Heat Treatment | Yield Strength kpsi | Ultimate Tensile Strength kpsi |
| 70 | 30 | 72.8 | 69.1 | — | 5.2 | 15.6 |
| 65 | 35 | 66.8 | 71.2 | — | 4.2 | 15.0 |
| | | | Alloy B | | | |
| 100 | 0 | 69.9 | 74.3 | 94.1 | — | 9.0 |
| 90 | 10 | 70.6 | 61.8 | 88.5 | — | 7.9 |
| 85 | 15 | 65.9 | 66.9 | 90.4 | — | 8.7 |
| 80 | 20 | 62.9 | 58.3 | 82.3 | — | 5.9 |
| 75 | 25 | 75.2 | 74.0 | 92.2 | — | 10.5 |
| 70 | 30 | 69.0 | 73.2 | 91.4 | — | 5.2 |
| 65 | 35 | 76.4 | 77.2 | 95.0 | — | 6.3 |
| | | | Alloy F214* | | | |
| 100 | 0 | 21.0 | 20.6 | — | 5.1 | 9.4 |
| 90 | 10 | 22.5 | 26.9 | — | 8.0 | 10.6 |
| 85 | 15 | 24.1 | 27.1 | — | 8.9 | 13.1 |
| 80 | 20 | 28.2 | 31.1 | — | 6.2 | 12.1 |
| 75 | 25 | 24.3 | 36.8 | — | 7.9 | 14.6 |
| 70 | 30 | 20.7 | 32.9 | — | 7.7 | 10.8 |
| 65 | 35 | 23.3 | 31.6 | — | 6.9 | 7.9 |
| 60 | 40 | 40.6 | 49.5 | — | 5.9 | 14.4 |
| 50 | 50 | 42.7 | 45.3 | — | 4.5 | 8.2 |
| 40 | 60 | 76.3 | 72.8 | — | 7.1 | 16.6 |

*Heat treated at 650°F

EXAMPLE 9

Using Alloy F214, and following the procedures described hereinbefore, a variety of composites were prepared. Hardness and tensile strength of these composites were compared as a function of the level of alumina loading at various percentages from 0 to 25. Rockwell E hardness tests were conducted on the composites as cast and after 650°F heat treatment for two hour with air cooling. Measurements were taken on the top side and bottom side of most of the composite sample. The results of these hardness tests, with standard deviation indicated, and tensile strengths are set forth in Table III as follows:

Table III

| Hardness and Strength | | | | | | |
|---|---|---|---|---|---|---|
| | | Alloy F214 — Rockwell E Hardness | | | | |
| | | As Cast | | After 650°F Heat Treatment | | |
| Weight % Alloy | Weight % Alumina | Top Side | Bottom Side | Top Side | Bottom Side | Tensile Strength psi |
| 100 | 0 | 45.8 ± 7.7 | — | 32.0 ± 12.1 | 35.9 ± 6.9 | 22,360 |
| 95 | 5 | 47.6 ± 4.3 | 52.8 ± 3.5 | 51.2 ± 3.5 | 56.9 ± 3.9 | 14,664 |
| 90 | 10 | 44.8 ± 5.2 | 50.7 ± 9.8 | 47.2 ± 4.3 | 49.8 ± 6.9 | 14,352 |
| 85 | 15 | 52.0 ± 6.2 | — | 52.2 ± 3.6 | 58.2 ± 1.3 | 15,184 |
| 80 | 20 | 29.8 ± 8.1 | 47.1 ± 11.4 | 35.7 ± 4.7 | 53.0 ± 4.6 | 12,688 |
| 75 | 25 | 25.4 ± 4.3 | 42.6 ± 6.3 | 29.9 ± 3.3 | 48.1 ± 5.7 | 11,856 |

EXAMPLE 10

Employing the foregoing procedure 1400 parts of F214 aluminum alloy and 600 parts of kyanite (a concentrate obtained from kyanite ore) were used to prepare a composite product. All of the kyanite was incorporated in the casting. The kyanite had a mesh size distribution as follows:

| Mesh Size | Percent |
|---|---|
| +40 | 1.8 |
| 40–70 | 19.0 |
| 70–100 | 19.0 |
| 100–170 | 20.2 |
| 170–200 | 11.8 |
| 200–325 | 15.6 |
| 325–400 | 11.3 |

-continued

| Mesh Size | Percent |
|---|---|
| −400 | 1.5 |

A standard heat treatment prescribed for F214 alloy was conducted for two hours at 650°F with an air quench. Rockwell E hardness tests were made on the top side and bottom side of the cast composite resulting in readings, with standard deviation, of 41.8 ± 6.5 and 54.4 ± 3.6, respectively.

EXAMPLE 11

Following the foregoing procedure, an excellent casting of an electrical conduit junction box was made using Alloy F214 and 25 weight percent zircon. The zircon was 50 percent whole grain and 50 percent finely ground.

EXAMPLE 12

Following the usual procedure, aluminum composites were prepared using calcium and beryllium as the metal reducing agent and zircon or alumina as the filler. Good composites were obtained. At 850°C, calcium and beryllium are soluble in aluminum in weight percent of about 20 and 24 percent, respectively.

Some control of the physical properties of the aluminum composite of this invention may be obtained by selection of an appropriate filler material. If a tough cut or drill resistant composite at some sacrifice of density is desired, zircon may be selected as a filler. If such properties are of less importance and low density is desired, alumina would probably be selected as the filler.

Hardness of the aluminum composite is almost independent of the filler selected, but toughness is highly dependent on the nature of the filler.

The volume of the filler in the metallic phase is the crucial factor in determining the amount of filler that can be accepted by the metallic phase and still retain metallic like properties. The weight percent of filler that may be used is different for each filler and is dependent upon the filler density.

Intricate castings can be satisfactorily produced using the molten filled aluminum composite of this invention with little or no loss of desired physical properties as compared with a comparable unfilled aluminum or aluminum alloy casting.

The foregoing disclosure and description of the invention is illustrative and explanatory thereof and various changes may be made within the scope of the appended claims without departing from the spirit of the invention.

What is claimed is:

1. A method for producing a high-strength aluminum composite product containing aluminum as the principal metal and a dispersion therein of a non-metal particulated filler substantially insoluble in the aluminum, which method comprises the following steps: bringing together with stirring a) a quantity of molten aluminum heated to a temperature of about 800 to about 850°C to achieve good fluidity, b) about 5 to about 80 percent zircon by weight of the composite, the zircon having a particle size of about 60 mesh to about 400 mesh U.S. Sieve Series, and c) about 2 to about 10 percent alkaline earth metal by weight of the metallic phase of the composite, continuing the stirring to cause the alkaline earth metal to reduce only the surfaces of the zircon particles and because of such reduction to cause the zircon particles to become substantially stably dispersed throughout the molten metallic phase, and casting the resulting dispersion in a mold to solidify the molten portion and give the composite the desired configuration.

2. The combination of claim 1 in which pieces of the cast solidified product are remelted and recast.

3. The combination of claim 1 in which the alkaline earth metal is magnesium.

4. The combination of claim 1 in which the zircon is in an amount from about 10 to about 40 weight percent of the composite.

5. The product produced by the method of claim 1.

6. The product produced by the method of claim 3.

* * * * *